US009797397B2

(12) United States Patent
Wojcik et al.

(10) Patent No.: US 9,797,397 B2
(45) Date of Patent: Oct. 24, 2017

(54) PUMP SLEEVE

(71) Applicant: Hamilton Sundstrand Corporation, Charlotte, NC (US)

(72) Inventors: Craig J. Wojcik, Frankfort, IL (US); Andrew P. Grosskopf, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 41 days.

(21) Appl. No.: 14/846,180

(22) Filed: Sep. 4, 2015

(65) Prior Publication Data

US 2017/0067460 A1 Mar. 9, 2017

(51) Int. Cl.

| | |
|---|---|
| ***F04B 53/16*** | (2006.01) |
| ***F04B 41/06*** | (2006.01) |
| ***F04B 53/22*** | (2006.01) |

(52) U.S. Cl.

CPC ..... *F04B 53/16* (2013.01); *F04B 41/06* (2013.01); *F04B 53/22* (2013.01)

(58) Field of Classification Search

CPC ..... Y10T 29/496; B21D 28/28; F16L 21/002; F16L 21/05

See application file for complete search history.

(56) References Cited

U.S. PATENT DOCUMENTS

| | | | | |
|---|---|---|---|---|
| 1,633,798 | A * | 6/1927 | Taylor | F16L 21/002 285/330 |
| 3,847,487 | A * | 11/1974 | Boll | G01N 21/15 356/438 |
| 4,040,003 | A * | 8/1977 | Beynet | E21B 47/14 175/40 |
| 4,252,035 | A | 2/1981 | Cordner et al. | |
| 4,284,913 | A | 8/1981 | Barnhardt | |
| 4,734,590 | A | 3/1988 | Fluegel | |
| 4,953,663 | A | 9/1990 | Sugden | |
| 5,028,803 | A | 7/1991 | Reynolds | |
| 6,183,167 | B1 * | 2/2001 | Ruiz | E02D 5/285 403/379.3 |
| 2013/0288840 | A1 | 10/2013 | Grosskopf et al. | |
| 2014/0007741 | A1 | 1/2014 | Vanderzyden et al. | |
| 2014/0008170 | A1 | 1/2014 | Vanderzyden et al. | |
| 2014/0009125 | A1 | 1/2014 | Vanderzyden et al. | |
| 2014/0009126 | A1 | 1/2014 | Vanderzyden et al. | |

* cited by examiner

*Primary Examiner* — Adam Krupicka
(74) *Attorney, Agent, or Firm* — Kinney & Lange, P.A.

(57) ABSTRACT

A pump sleeve includes a tubular body extending from a first end to a second end along a center axis. A first hole is formed in the tubular body and is positioned axially on the tubular body between the first end and the second end. A second hole is formed in the tubular body, the second hole being axially aligned on the tubular body with the first hole. A third hole is formed in the tubular body and is positioned axially on the tubular body between the first end and the first hole. A fourth hole is formed in the tubular body, the fourth hole being axially aligned on the tubular body with the third hole.

12 Claims, 7 Drawing Sheets

PUMP SLEEVE

BACKGROUND

This disclosure is directed generally to an integrated drive generator for use with an aircraft gas turbine engine, and more specifically, to an oil pump assembly of an integrated drive generator.

Integrated drive generators have been in use for many years in generating electrical power on airframes. An integrated drive generator functions to produce a constant three-phase 400 Hz alternating current when driven by a variable speed gearbox located on an airframe propulsion engine, generally a gas turbine engine. The integrated drive generator is a single unit that includes a hydraulic speed trimming device and an alternating current generator mounted within a case assembly. The hydraulic speed trimming device converts a variable speed shaft input from a gearbox on a gas turbine engine to a constant speed shaft output to drive the alternating current generator.

The integrated drive generator also generally includes a scavenge pump, an inversion pump, and a charge pump disposed within the case assembly of the integrated drive generator. The scavenge pump draws oil from an oil sump located in the bottom of the case and supplies the oil to a filter which removes various debris within the oil prior to entering the cooling circuit located external to the integrated drive generator on the aircraft. The output of the deaerator, which contains oil of higher quality than that pumped by the scavenge pump, is applied to the intake of the charge pump. The charge pump pressurizes the oil and applies the oil to an oil circuit. The oil circuit supplies oil to the hydraulic speed trimming device, to the alternating current generator for cooling and lubricating the alternating current generator, to the casing of the integrated drive generator for cooling, and to other components of the integrated drive generator that require oil circulation for cooling and/or lubrication. Generally, an assembly of gears is used to mechanically connect the scavenge pump, the inversion pump, and charge pump to the output of the hydraulic speed trimming device.

Should any part of the integrated drive generator require maintenance or replacement, an operator generally must open the case assembly and at least partially disassemble the integrated drive generator. Reducing the complexity of the integrated drive generator results in maintenance cost savings by reducing the amount of parts to maintain within the integrated drive generator and the amount of time required to disassemble and reassemble the integrated drive generator. Reducing the complexity of the integrated drive generator also results in manufacturing cost savings by reducing the number of parts needed to produce the integrated drive generator and the time required to assemble the integrated drive generator.

SUMMARY

In one aspect of the invention, a pump sleeve includes a tubular body extending from a first end to a second end along a center axis. A first hole is formed in the tubular body and is positioned axially on the tubular body between the first end and the second end. A second hole is formed in the tubular body, the second hole being axially aligned on the tubular body with the first hole. A third hole is formed in the tubular body and is positioned axially on the tubular body between the first end and the first hole. A fourth hole is formed in the tubular body, the fourth hole being axially aligned on the tubular body with the third hole. A fifth hole is formed in the tubular body and is positioned axially on the tubular body between the first end and the third hole. A sixth hole formed in the tubular body, the sixth hole being axially aligned on the tubular body with the fifth hole.

In another aspect of the invention, a pump sleeve includes a tubular body extending from a first end to a second end along a center axis. A first hole is formed in the tubular body and is positioned axially on the tubular body between the first end and the second end. A second hole is formed in the tubular body, the second hole being axially aligned on the tubular body with the first hole. A third hole is formed in the tubular body and is positioned axially on the tubular body between the first end and the first hole. A fourth hole is formed in the tubular body, the fourth hole being axially aligned on the tubular body with the third hole.

Persons of ordinary skill in the art will recognize that other aspects and embodiments of the present invention are possible in view of the entirety of the present disclosure, including the accompanying figures.

Figure 1:
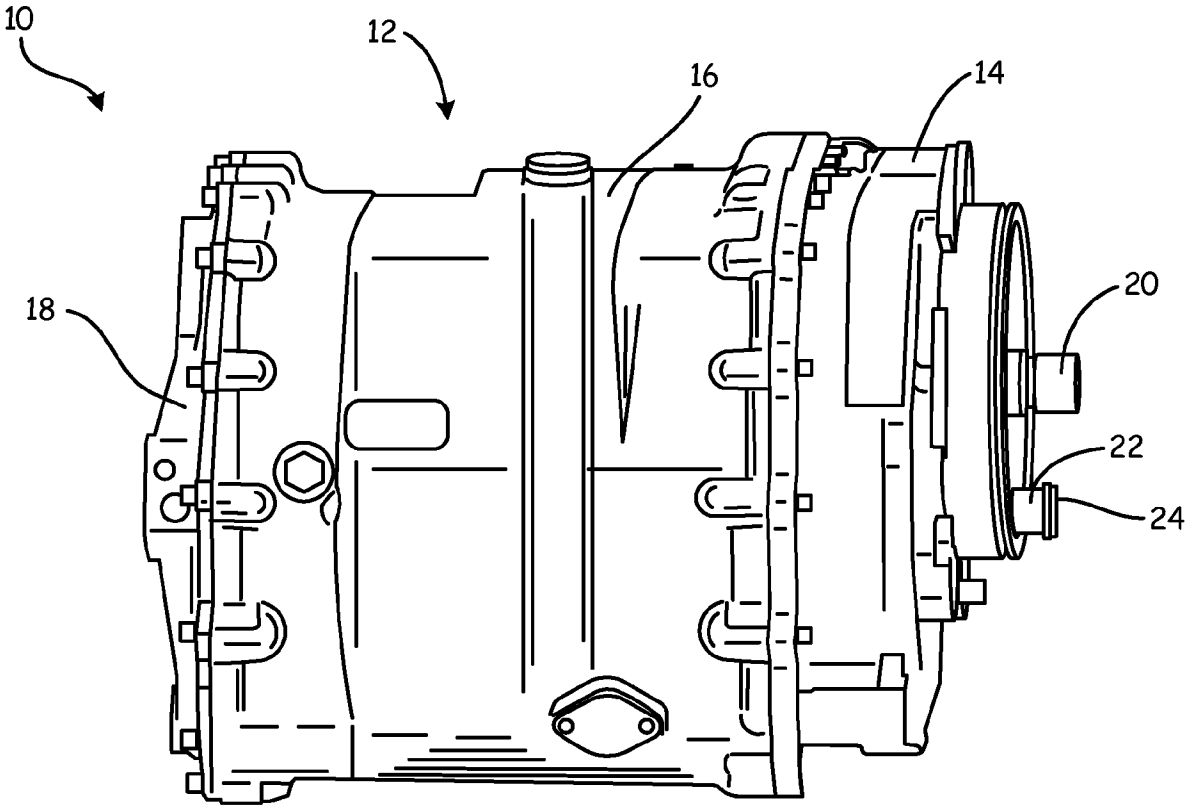
FIG. 1 is a perspective view of an integrated drive generator.

While the above-identified drawing figures set forth one or more embodiments of the invention, other embodiments are also contemplated. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings. Like reference numerals identify similar structural elements.

DETAILED DESCRIPTION

The present disclosure provides an integrated drive generator for use with a gearbox on a gas turbine engine. The integrated drive generator includes a pump assembly with a pump sleeve that at least partially houses a charge pump, a scavenge pump, and an inversion pump within the integrated drive generator. The pump sleeve simplifies the assembly of the integrated drive generator by combining the charge pump, the scavenge pump, and the inversion pump into a single unit that requires fewer attachment components than prior art assemblies to connect the charge pump, the scavenge pump, and the inversion pump within the integrated drive generator. Furthermore, aligning the charge pump, the scavenge pump, and the inversion pump within the pump sleeve provides for fewer gears and fewer provisions for mounting the gears within the integrated drive generator. Reducing the number of gears and other parts within integrated drive generator increases the service life of integrated drive generator by reducing the amount of internal vibration caused by moving components and the wear and tear associated with internal vibration.

Figure 2:
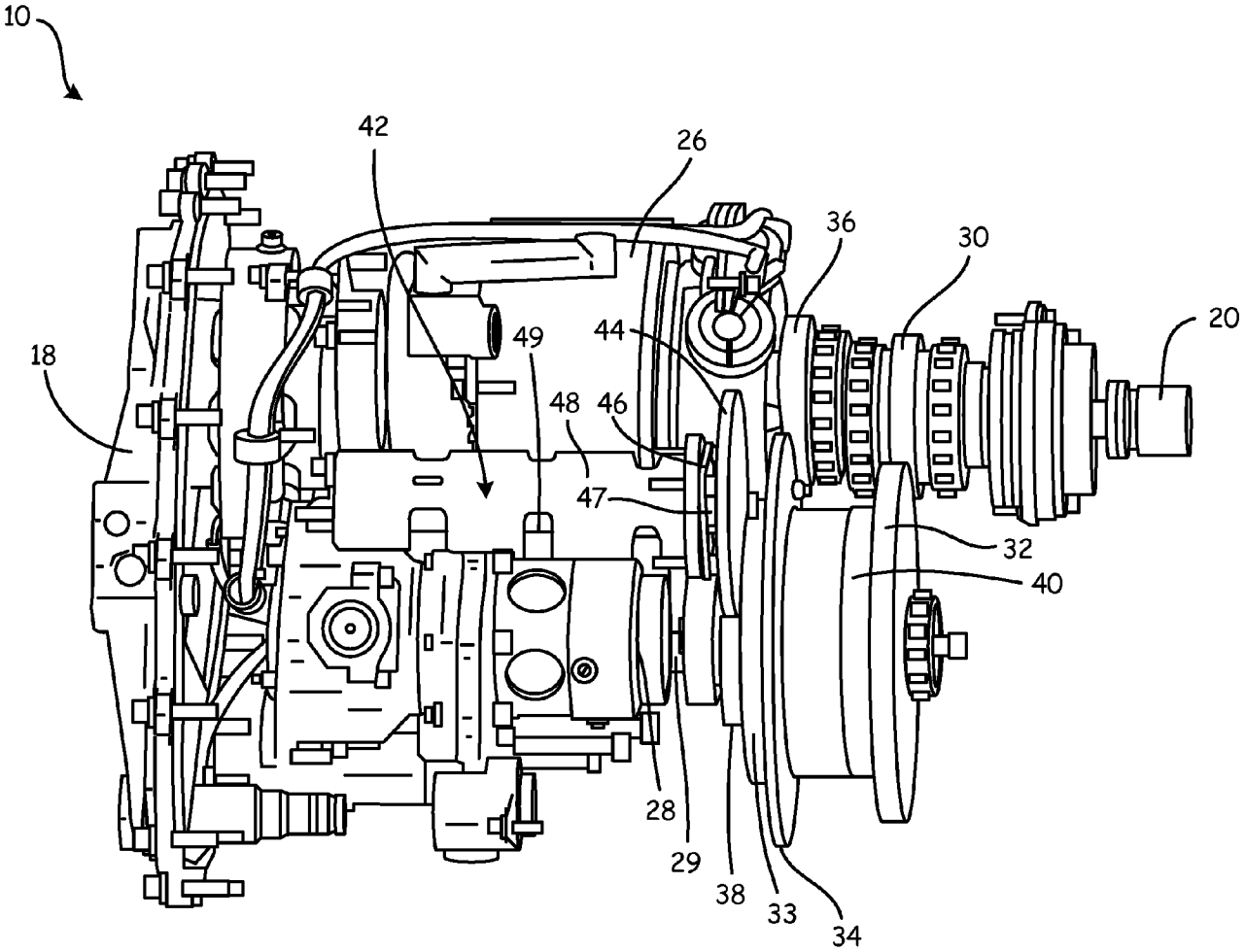
FIG. 2 is a perspective view of the integrated drive generator of FIG. 1 with a housing assembly removed.

FIGS. 1-2 will be discussed concurrently. FIG. 1 is a perspective view of integrated drive generator (IDG) 10 with housing assembly 12. As shown in FIG. 1, housing assembly 12 can include input housing 14, center housing 16, and end housing 18. FIG. 2 is a perspective view of IDG 10 of FIG. 1 with input housing 14 and center housing 16 of housing assembly 12 removed. In addition to housing assembly 12, IDG 10 can also include variable speed input shaft 20, oil outlet 22, oil inlet 24, generator 26, hydraulic speed trimming device 28, input drive gear 30, input driven gear 32, output ring gear 34, generator driven gear 36, accessory drive gear 38, differential 40, and pump assembly 42. Pump assembly 42 can include pump gear 44, pump cover 46, pump drive shaft 47, pump sleeve 48, and pump interior components 49.

Generator 26, hydraulic speed trimming device 28, and pump assembly 42 are all contained within housing assembly 12. As shown in FIG. 1, housing assembly 12 is assembled around generator 26, hydraulic speed trimming device 28 and pump assembly 42 by connecting center housing 16 between input housing 14 and end housing 18. Variable speed input shaft 20 extends across input housing 14 and into the interior of IDG 10. An end of variable speed input shaft 20, disposed outside of housing assembly 12, interfaces with a gearbox on a gas turbine engine such that the gearbox on the gas turbine engine rotates variable speed input shaft 20 at a variable speed. Input drive gear 30 is disposed within housing assembly 12 and is mechanically connected to variable speed input shaft 20 such that variable speed input shaft 20 rotates input drive gear 30 at a variable speed. Input driven gear 32 is disposed within housing assembly 12 and is meshed with input drive gear 30 such that input drive gear 30 rotates input driven gear 32 at a variable speed. As input drive gear 30 rotates input driven gear 32, input driven gear 32 causes a rotation to (not shown), internal to differential 40, which rotates a variable coaxial shaft (not shown) of hydraulic speed trimming device 28 at a variable speed. Hydraulic speed trimming device 28 uses the variable input speed of the variable coaxial shaft (not shown) to trim the variable speed which results in the fixed coaxial shaft 29 rotating to adjust the speed of a sun gear (not shown). The sun gear (not shown) interacts with planet gears (not shown) mounted in the carrier shaft to rotate the output ring gear at a constant speed. Fixed coaxial shaft 29 is disposed around variable coaxial shaft (not shown) such that fixed coaxial shaft 29 is coaxial with variable coax shaft (not shown).

A mounting bracket 33 is attached to output ring gear 34. Accessory drive gear 38 is connected to mounting bracket 33. Hydraulic speed trimming device 28 in conjunction with the differential 40 rotates the output ring gear 34, accessory drive gear 38 and generator driven gear 36 at a constant speed. As shown in FIG. 2, differential 40 can be disposed axially between output ring gear 34 and input driven gear 32. Differential 40 can also mechanically connect input driven gear 32 to variable coaxial shaft (not shown) which is concentric with the fixed coaxial shaft 29. Output ring gear 34 can be disposed between differential 40 and accessory drive gear 38. Accessory drive gear 38, output ring gear 34, and input driven gear 32 can be coaxial and can all be disposed on the same side or end of hydraulic speed trimming device 28. Coaxially aligning accessory drive gear 38, output ring gear 34, and input driven gear 32 within IDG 10 can help reduce the overall size of IDG 10. Positioning accessory drive gear 38, output ring gear 34, and input driven gear 32 on the same side or end of hydraulic speed trimming device 28 reduces the total size of the IDG 10 while ensuring the variable input speed is trimmed to output a fixed speed for output ring gear 34. Should an operator need to inspect or perform maintenance on accessory drive gear 38, output ring gear 34, and input driven gear 32, the operator need only remove a portion of housing assembly 12, such as input housing 14, to access accessory drive gear 38, generator driven gear 36, and input driven gear 32.

Generator driven gear 36 meshes with output ring gear 34 such that output ring gear 34 rotates generator driven gear 36 at a constant speed. Generator driven gear 36 is connected to a rotor (not shown) of generator 26 which rotates at a constant speed due to the interaction of output ring gear 34 and generator driven gear 36. Generator 26 can be an alternating current electrical generator.

Accessory drive gear 38 can mesh with pump gear 44 such that accessory drive gear 38 rotates pump gear 44 at a constant speed. Pump gear 44 is connected to pump drive shaft 47 such that pump drive shaft 47 rotates in unison with pump gear 44. The rotation of pump drive shaft 47 spins pump interior components 49 of pump assembly 42 such that pump assembly 42 can circulate oil within IDG 10, out of IDG 10 through oil outlet 22, and back into IDG 10 through oil inlet 24. As discussed below with reference to FIGS. 3-6, pump sleeve 48 at least partially houses pump interior components 49 of pump assembly 42 into a relatively compact unit that is relatively simple to install inside housing assembly 12 of IDG 10.

Figure 3:
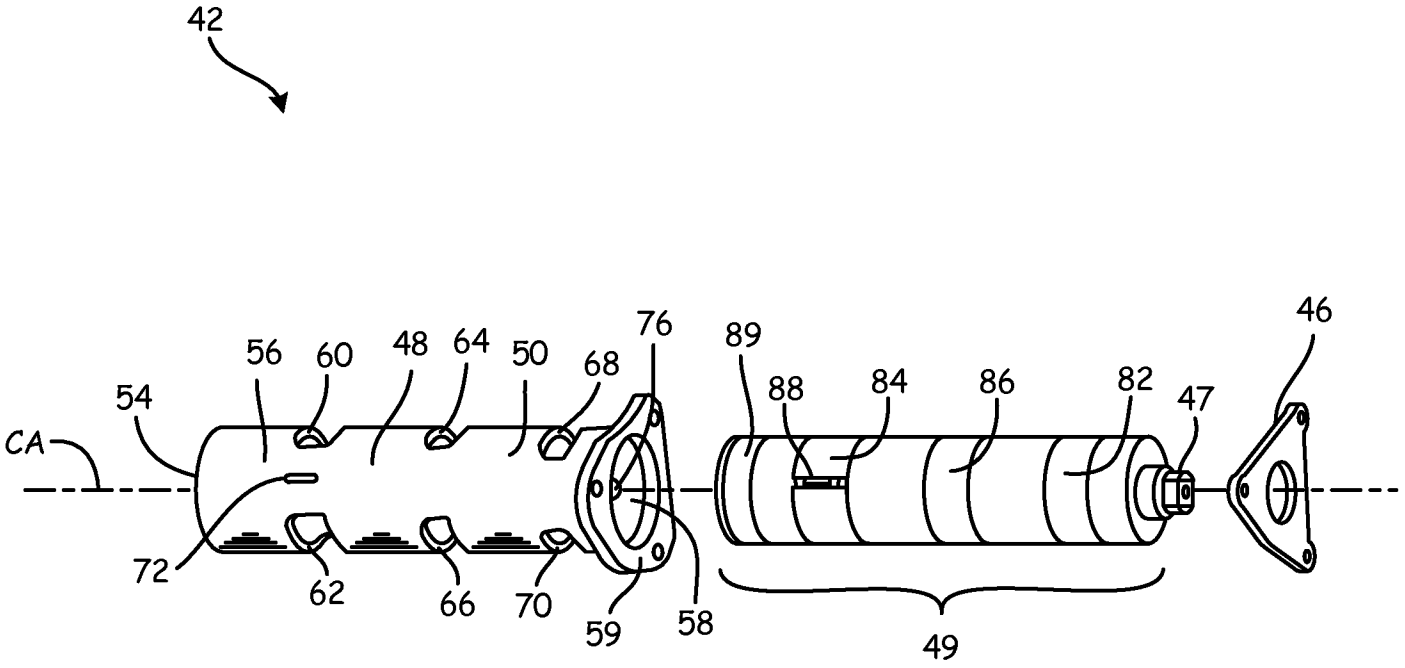
FIG. 3 is an exploded view of a pump assembly from the integrated drive generator of FIG. 2.
Figure 4A:
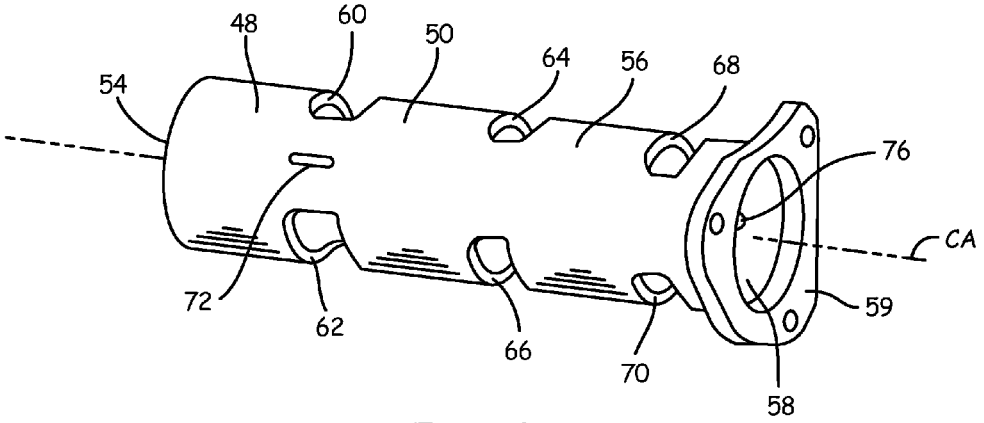
FIG. 4*a* is a perspective view of a pump sleeve from the pump assembly of FIG. 3.
Figure 4B:
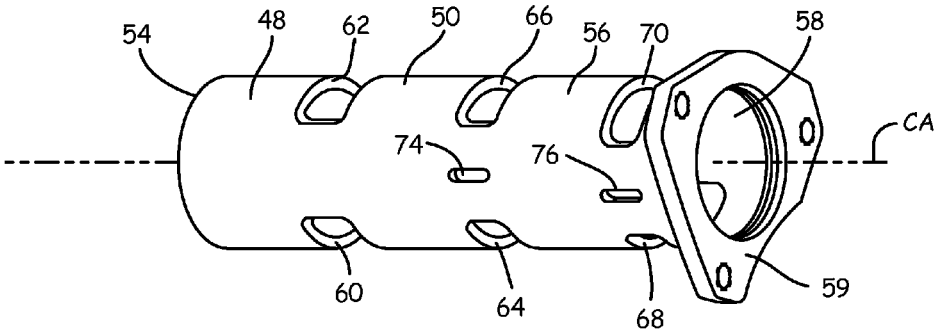
FIG. 4*b* is another perspective view of the pump sleeve of FIG. 4*a* rotated approximately 180 degrees about a center axis of the pump sleeve and pump assembly.
Figure 5:
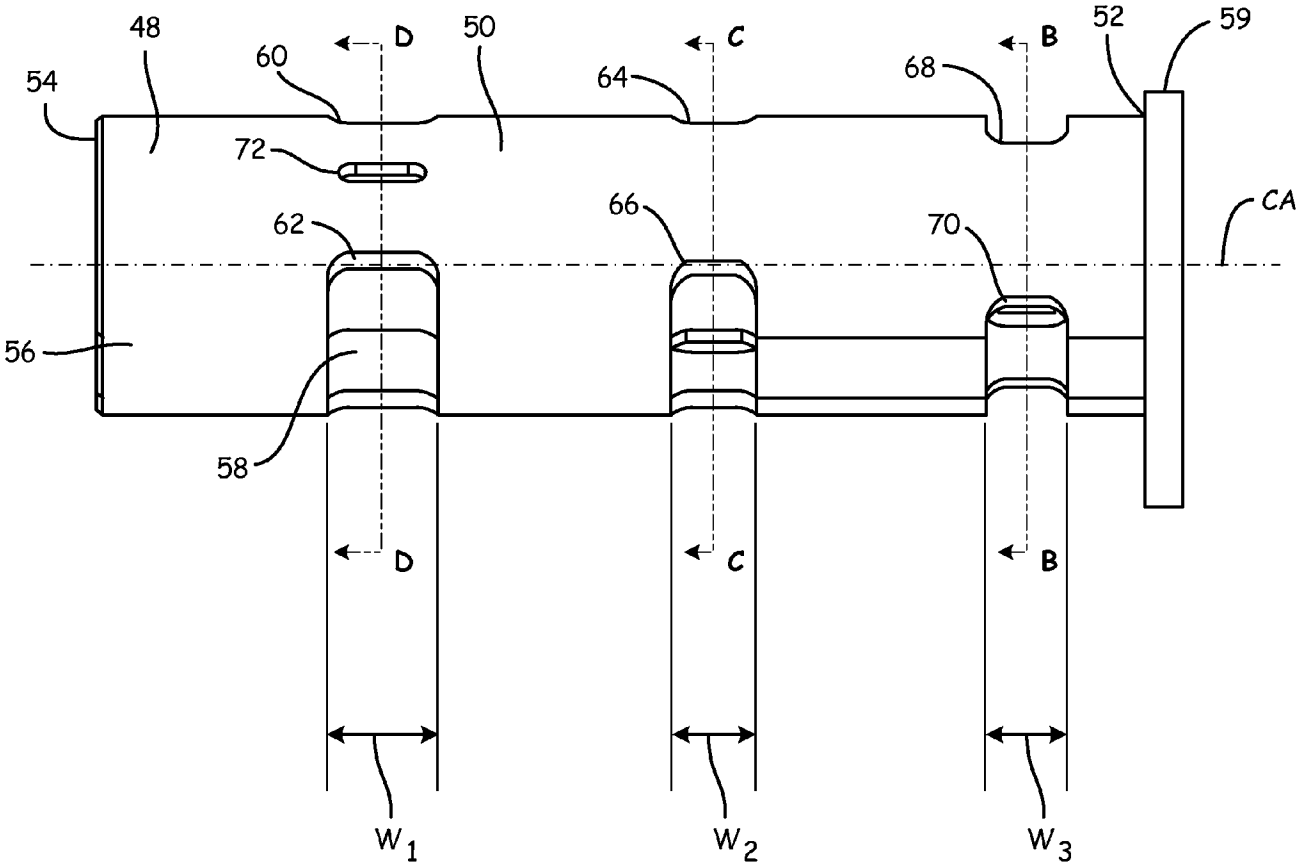
FIG. 5 is an elevation view of the pump sleeve of FIG. 4*a*.
Figure 6:
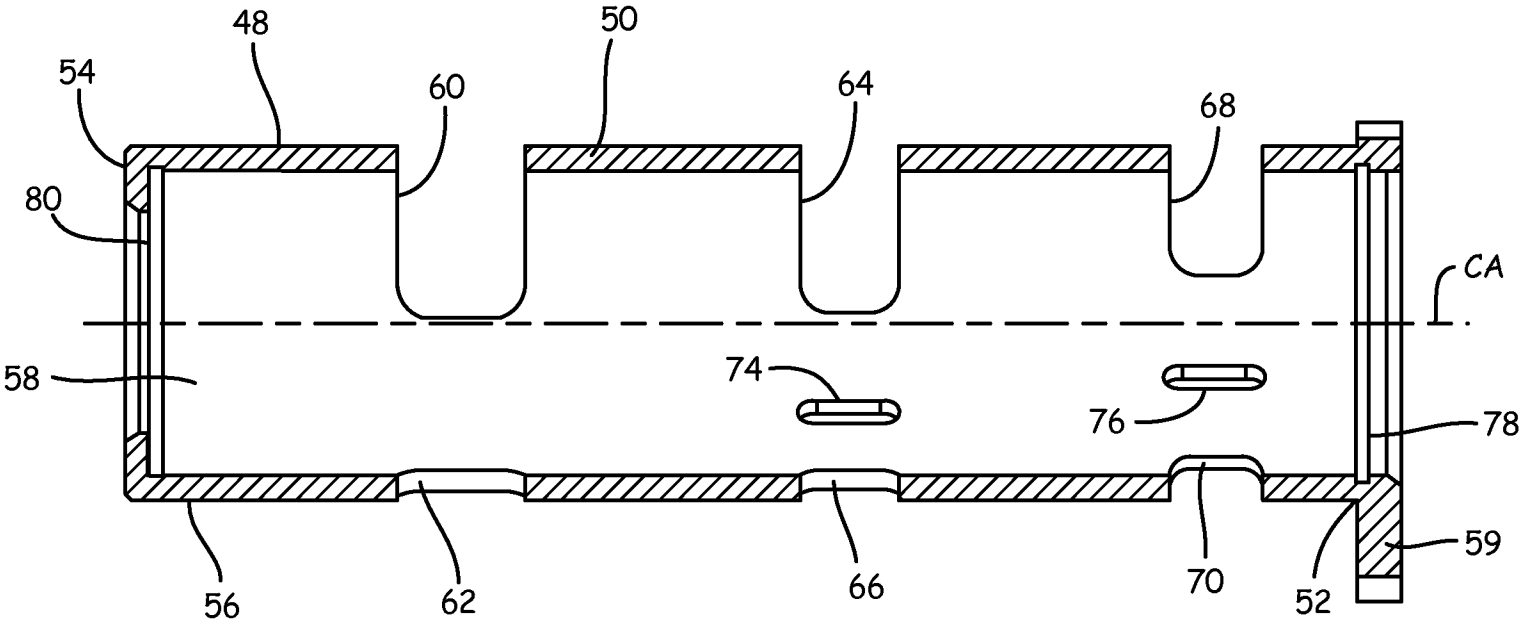
FIG. 6 is a cross-sectional view of the pump sleeve of FIG. 5.
Figure 7A:
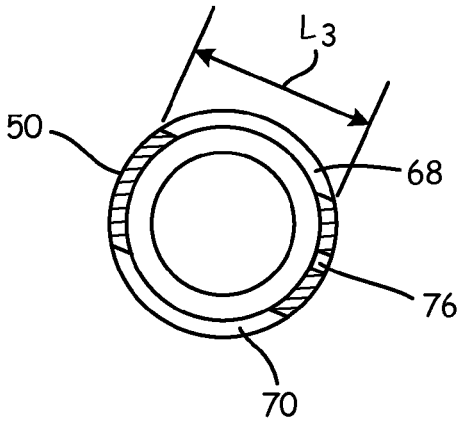
FIG. 7*a* is a cross-sectional view of the pump sleeve of FIG. 5 taken along line B-B.
Figure 7B:
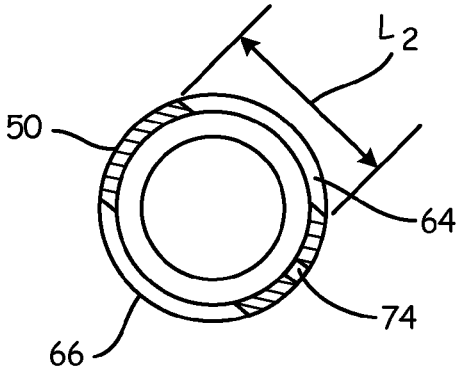
FIG. 7*b* is a cross-sectional view of the pump sleeve of FIG. 5 taken along line C-C.
Figure 7C:
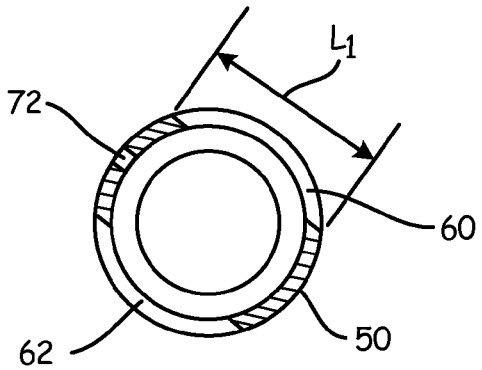
FIG. 7*c* is a cross-sectional view of the pump sleeve of FIG. 5 taken along line D-D.

FIGS. 3-6 will be discussed concurrently. FIG. 3 is an exploded view of pump assembly 42 from IDG 10 of FIG. 2. FIG. 4*a* is a perspective view of pump sleeve 48 from pump assembly 42 of FIG. 3, and FIG. 4*b* is another perspective view of pump sleeve 48 of FIG. 4*a* rotated approximately 180 degrees about center axis CA of pump sleeve 48 and pump assembly 42. FIG. 5 is an elevation view of pump sleeve 48 of FIG. 4*a*, and FIG. 6 is a cross-sectional view of pump sleeve 48 of FIG. 5. As shown in FIGS. 3-6, pump sleeve 48 includes tubular body 50. Tubular body 50 can include first end 52, second end 54, outside surface 56, inside surface 58, and center axis CA. First end 52 of tubular body 50 can include mounting flange 59 to help connect the entire pump assembly 42 to IDG 10. Pump sleeve 48 can further include first hole 60, second hole 62, third hole 64, fourth hole 66, fifth hole 68, sixth hole 70, first slot 72, second slot 74, third slot 76, first groove 78, and second groove 80. As shown in FIG. 5 and FIG. 7C, first hole 60 and second hole 62 can each include axial width $W_1$ and circumferential length $L_1$, respectively. As shown in FIG. 5 and FIG. 7B, third hole 64 and fourth hole 66 can each include axial width $W_2$ and circumferential length $L_2$, respectively. As shown in FIG. 5 and FIG. 7A, fifth hole 68 and sixth hole 70 can each include axial width $W_3$ and circumferential length $L_3$, respectively. As shown in FIG. 3, pump interior components 49 can include charge pump 82, scavenge pump 84, and inversion pump 86.

Tubular body 50 extends from first end 52 toward second end 54 along center axis CA. Tubular body 50 can have a length of about 5.616 inches (14.265 cm) to about 5.626 inches (14.290 cm) between first end 52 and second end 54. Outside surface 56 of tubular body 50 can include a diameter of about 1.5932 inches (4.0467 cm) to about 1.5938 inches (4.0482 cm), and inside surface 58 of tubular body 50 can include an a diameter of about 1.3750 inches (3.4925 cm) to about 1.3758 inches (3.4945 cm). Center axis CA can be the center axis for tubular body 50, pump sleeve 48, and pump assembly 42. Pump sleeve 48 can be formed from metal material, such as steel, titanium, aluminum, alloys, superalloys, and/or other various types of metals. As shown in FIGS. 3-6, first hole 60, second hole 62, third hole 64, fourth hole 66, fifth hole 68, and sixth hole 70 are all formed in tubular body 50. First hole 60 can be positioned axially on tubular body 50 between first end 52 and the second end 54. Second hole 62 can be axially aligned on tubular body 50 with first hole 60. Third hole 64 can be positioned axially on tubular body 50 between first end 52 and first hole 60. Fourth hole 66 can be axially aligned on tubular body 50 with third hole 64. Fifth hole 68 can be positioned axially on tubular body 50 between first end 52 and third hole 64. Sixth hole 70 can be axially aligned on tubular body 50 with fifth hole 68.

Each of charge pump 82, scavenge pump 84, and inversion pump 86 can individually be a rotary vane pump. First end 52 of tubular body 50 can be open such that charge pump 82, scavenge pump 84, and inversion pump 86 can be inserted into pump sleeve 48. When pump interior components 49 are assembled within pump sleeve 48, as shown in FIG. 3, inversion pump 86 is disposed axially between scavenge pump 84 and charge pump 82, with scavenge pump 84 disposed proximate second end 54 of tubular body 50 and charge pump 82 disposed proximate first end 52 of tubular body 50. First hole 60 and second hole 62 of tubular body 50 are positioned over scavenge pump 84. Third hole 64 and fourth hole 66 of tubular body 50 are positioned over inversion pump 86. Fifth hole 68 and sixth hole 70 of tubular body 50 are positioned over charge pump 82. Pump cover 46 is removably connected to mounting flange 59 on first end 52 of tubular body 50 to retain charge pump 82, scavenge pump 84, and inversion pump 86 within pump sleeve 48. As shown in FIG. 6, first groove 78 can be formed on inside surface 58 of tubular body 50 proximate first end 52, and second groove 80 can be formed on inside surface 58 of tubular body 50 proximate second end 54. The first groove 78 can extend the full circumference of inside surface 58 and can be used to accommodate a snap ring 89. When used in conjunction with a snap ring, first groove 78 of tubular body 50 helps keep charge pump 82, scavenge pump 84, and inversion pump 86 tightly stacked within pump sleeve 48. Keeping charge pump 82, scavenge pump 84, and inversion pump 86 tightly stacked within pump sleeve 48 helps with disassembly, if required. Second end 54 of tubular body 50 can be open to reduce the overall mass and weight of tubular body 50 and pump sleeve 48 along with providing an opening to the case to prevent over-pressurization due to fluid buildup.

Pump drive shaft 47 is connected to charge pump 82, scavenge pump 84, and inversion pump 86 and can extend through pump cover 46 to connect with pump gear 44, as shown in FIG. 2. Mounting flange 59 can connect pump assembly 42 to interior walls (not shown) formed on center housing 16 of housing assembly 12 (shown in FIG. 1). During operation, pump drive shaft 47 actuates charge pump 82, scavenge pump 84, and inversion pump 86 at a constant speed. As pump drive shaft 47 actuates scavenge pump 84, fluid can enter scavenge pump 84 through second hole 62 of tubular body 50 and can exit scavenge pump 84 through first hole 60 of tubular body 50. As pump drive shaft 47 actuates inversion pump 86, fluid can enter inversion pump 86 through third hole 64 of tubular body 50 and can exit inversion pump 86 through fourth hole 66 of tubular body 50. As pump drive shaft 47 actuates charge pump 82, fluid can enter charge pump 82 through fifth hole 68 of tubular body 50 and can exit charge pump 82 through sixth hole 70 of tubular body 50.

First slot 72, second slot 74, and third slot 76 can be anti-rotation slots formed on tubular body 50. As best shown in FIG. 3, first slot 72, second slot 74, and third slot 76 can each mate with one of anti-rotation tabs 88 (only one of which is shown in FIG. 3) disposed on charge pump 82, scavenge pump 84, and inversion pump 86. First slot 72, second slot 74, third slot 76, and anti-rotation tabs 88 help keep first hole 60, second hole 62, third hole 64, fourth hole 66, fifth hole 68, and sixth hole 70 of tubular body 50 properly positioned with pump interior components 49 so that tubular body 50 does not impede the flow of fluid across charge pump 82, scavenge pump 84, and inversion pump 86 during operation while at the same time providing a means of assembly and helping maintain orientation of liners relative to holes 60, 62, 64, 66, 68, and 70. As best shown in FIGS. 4*a*-4*b*, first slot 72 can be axially aligned on tubular body 50 with first hole 60 and second hole 62 and can be disposed circumferentially on tubular body 50 between first hole 60 and second hole 62. Second slot 74 can be axially aligned on tubular body 50 with third hole 64 and fourth hole 66 and can be disposed circumferentially on tubular body 50 between third hole 64 and fourth hole 66. Third slot 76 can be axially aligned on tubular body 50 with fifth hole 68 and sixth hole 70 and can be disposed circumferentially on tubular body 50 between fifth hole 68 and sixth hole 70.

As shown in FIG. 5, axial width $W_1$ of first hole 60 and second hole 62 is the width for both first hole 60 and second hole 62 in a direction parallel with center axis CA. Axial width $W_2$ of third hole 64 and fourth hole 66 is the width for both third hole 64 and fourth hole 66 in a direction parallel with center axis CA. Axial width $W_3$ of fifth hole 68 and sixth hole 70 is the width for both fifth hole 68 and sixth hole 70 in a direction parallel with center axis CA. Because the flow of fluid across scavenge pump 84 can be greater than the flow of fluid across inversion pump 86, axial width $W_1$ of first hole 60 and second hole 62 can greater than axial width $W_2$ of third hole 64 and fourth hole 66. For example, axial width $W_1$ can be nominally about 0.580 inches (1.473 cm) in length, and axial width $W_2$ can be nominally about 0.450 inches (1.143 cm) in length. Similarly, axial width $W_2$ of third hole 64 and fourth hole 66 can be greater than axial width $W_3$ of fifth hole 68 and sixth hole 70 so that inversion pump 86 can accommodate a different rate of flow than charge pump 82. For example, axial with $W_3$ can be nominally about 0.429 inches (1.089 cm) in length. As shown in FIGS. 7*a*-7*c*, first hole 60, second hole 62, third hole 64, fourth hole 66, fifth hole 68, and sixth hole 70 can all be equal in dimension in a direction of a circumference of tubular body 50 such that circumferential length $L_1$, circumferential length $L_2$, and circumferential length $L_3$ are equal in length. As discussed below with reference to FIGS. 7*a*-7*c*, first hole 60 and second hole 62 can be circumferentially offset from the other holes formed in tubular body 50 of pump sleeve 48.

FIG. 7*a* is a cross-sectional view of pump sleeve 48 of FIG. 5 taken along line B-B. FIG. 7*b* is a cross-sectional view of pump sleeve 48 of FIG. 5 taken along line C-C. FIG. 7*c* is a cross-sectional view of pump sleeve 48 of FIG. 5 taken along line D-D. First hole 60 and second hole 62 can be circumferentially offset on tubular body 50 from third hole 64, fourth hole 66, fifth hole 68, and sixth hole 70 so that scavenge pump 84 can direct fluid away from pump assembly 42 at a different direction or angle than charge pump 82 and inversion pump 86. In addition, third hole 64 and fourth hole 66 can be circumferentially offset on tubular body 50 from fifth hole 68 and sixth hole 70 so that inversion pump 86 can direct fluid away from pump assembly 42 at a different direction or angle than charge pump 82. For example, first hole 60 and second hole 62 can be circumferentially offset on tubular body 50 from third hole 64 and fourth hole 66 by nominally 14 degrees, while first hole 60 and second hole 62 can be circumferentially offset on tubular body 50 from fifth hole 68, and sixth hole 70 by nominally 16.3 degrees. In that same example, third hole 64 and fourth hole 66 can be circumferentially offset on tubular body 50 from fifth hole 68, and sixth hole 70 by nominally 2.3 degrees. Allowing charge pump 82, scavenge pump 84, and inversion pump 86 to direct fluid flow at different directions or angles allows pump assembly 42 the ability to efficiently move fluid to and from various locations within and without IDG 10. Circumferentially offsetting the holes in tubular body 50 also allows fluid passages (not shown) within center housing 16 to connect up with the holes of tubular body 50 in a tighter space and configuration.

In view of the foregoing description, it will be recognized that the present disclosure provides numerous advantages and benefits. For example, the present disclosure provides IDG 10 with pump assembly 42 with charge pump 82, scavenge pump 84, and inversion pump 86 all disposed within pump sleeve 48. Charge pump 82, scavenge pump 84, and inversion pump 86 can all be installed into IDG 10 by simply connecting mounting flange 59 of pump sleeve 48 within housing assembly 12 of IDG 10. Thus pump assembly 42 and IDG 10 overall use fewer fasteners and less area than IDG designs.

The following are non-exclusive descriptions of possible embodiments of the present invention.

In one embodiment, a pump sleeve includes a tubular body extending from a first end to a second end along a center axis. A first hole is formed in the tubular body and is positioned axially on the tubular body between the first end and the second end. A second hole is formed in the tubular body, the second hole being axially aligned on the tubular body with the first hole. A third hole is formed in the tubular body and is positioned axially on the tubular body between the first end and the first hole. A fourth hole is formed in the tubular body, the fourth hole being axially aligned on the tubular body with the third hole. A fifth hole is formed in the tubular body and is positioned axially on the tubular body between the first end and the third hole. A sixth hole formed in the tubular body, the sixth hole being axially aligned on the tubular body with the fifth hole.

The pump sleeve of the preceding paragraph can optionally include, additionally and/or alternatively, any one or more of the following features, configurations and/or additional components:

the first end of the tubular body is open;

the second end of the tubular body is open;

the first end of the tubular body further comprises a mounting flange;

a first slot formed on the tubular body, wherein the first slot is axially aligned on the tubular body with the first and second holes, and wherein the first slot is disposed circumferentially on the tubular body between the first and second holes;

a second slot formed on the tubular body, wherein the second slot is axially aligned on the tubular body with the third and fourth holes, and wherein the second slot is disposed circumferentially on the tubular body between the third and fourth holes;

a third slot formed on the tubular body, wherein the third slot is axially aligned on the tubular body with the fifth and sixth holes, and wherein the third slot is disposed circumferentially on the tubular body between the fifth and sixth holes;

the first hole and the second hole are both wider in a direction of the center axis than the third hole and the fourth hole;

the third hole and the fourth hole are both wider in the direction of the center axis than the fifth hole and the sixth hole;

the first, second, third, fourth, fifth and sixth holes are equal in dimension in a direction of a circumference of the tubular body; and/or a first groove formed on an inside surface of the tubular body proximate the first end; and a second groove formed on the inside surface of the tubular body proximate the second end.

In another embodiment, a pump sleeve includes a tubular body extending from a first end to a second end along a center axis. A first hole is formed in the tubular body and is positioned axially on the tubular body between the first end and the second end. A second hole is formed in the tubular body, the second hole being axially aligned on the tubular body with the first hole. A third hole is formed in the tubular body and is positioned axially on the tubular body between the first end and the first hole. A fourth hole is formed in the tubular body, the fourth hole being axially aligned on the tubular body with the third hole.

The pump sleeve of the preceding paragraph can optionally include, additionally and/or alternatively, any one or more of the following features, configurations and/or additional components:

a fifth hole formed in the tubular body and positioned axially on the tubular body between the first end and the third hole; and a sixth hole formed in the tubular body, wherein the sixth hole is axially aligned on the tubular body with the fifth hole;

the first hole and the second hole are circumferentially offset on the tubular body from the third, fourth, fifth, and sixth holes; and/or the third hole and the fourth hole are circumferentially offset on the tubular body from the fifth and sixth holes.

Any relative terms or terms of degree used herein, such as "substantially", "essentially", "generally", "approximately", and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, transitory vibrations and sway movements, temporary alignment or shape variations induced by operational conditions, and the like.

While the invention has been described with reference to an exemplary embodiment(s), it will be understood by those skilled in the art that various changes may be made and equivalents may be substituted for elements thereof without departing from the scope of the invention. For example, while FIGS. 3-6 show first slot 72, second slot 74, third slot 76, and anti-rotation tabs 88 as being elongated in the direction of center axis CA, first slot 72, second slot 74, third slot 76, and anti-rotation tabs 88 can include any geometry that allows first slot 72, second slot 74, third slot 76 to mate with anti-rotation tabs 88 to keep pump sleeve 48 properly position relative pump interior components 49. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A pump sleeve comprising:

a tubular body extending from a first end to a second end along a center axis;

a first hole formed in the tubular body and positioned axially on the tubular body between the first end and the second end;

a second hole formed in the tubular body, wherein the second hole is axially aligned on the tubular body with the first hole;

a third hole formed in the tubular body and positioned axially on the tubular body between the first end and the first hole;

a fourth hole formed in the tubular body, wherein the fourth hole is axially aligned on the tubular body with the third hole;

a fifth hole formed in the tubular body and positioned axially on the tubular body between the first end and the third hole; and a sixth hole formed in the tubular body, wherein the sixth hole is axially aligned on the tubular body with the fifth hole;

wherein the first hole and the second hole are both wider in a direction of the center axis than the third hole and the fourth hole; and wherein the third hole and the fourth hole are both wider in the direction of the center axis than the fifth hole and the sixth hole.

2. The pump sleeve of claim 1, wherein the first end of the tubular body is open.

3. The pump sleeve of claim 2, wherein the second end of the tubular body is open.

4. The pump sleeve of claim 2, wherein the first end of the tubular body further comprises a mounting flange.

5. The pump sleeve of claim 1, further comprising:

a first slot formed on the tubular body, wherein the first slot is axially aligned on the tubular body with the first and second holes, and wherein the first slot is disposed circumferentially on the tubular body between the first and second holes.

6. The pump sleeve of claim 5, further comprising:

a second slot formed on the tubular body, wherein the second slot is axially aligned on the tubular body with the third and fourth holes, and wherein the second slot is disposed circumferentially on the tubular body between the third and fourth holes.

7. The pump sleeve of claim 6, further comprising:

a third slot formed on the tubular body, wherein the third slot is axially aligned on the tubular body with the fifth and sixth holes, and wherein the third slot is disposed circumferentially on the tubular body between the fifth and sixth holes.

8. The pump sleeve of claim 1, wherein the first, second, third, fourth, fifth and sixth holes are equal in dimension in a direction of a circumference of the tubular body.

9. The pump sleeve of claim 1, further comprising:

a first groove formed on an inside surface of the tubular body proximate the first end; and a second groove formed on the inside surface of the tubular body proximate the second end.

10. A pump sleeve comprising:

a tubular body extending from a first end to a second end along a center axis;

a first hole formed in the tubular body and positioned axially on the tubular body between the first end and the second end;

a second hole formed in the tubular body, wherein the second hole is axially aligned on the tubular body with the first hole;

a third hole formed in the tubular body and positioned axially on the tubular body between the first end and the first hole;

a fourth hole formed in the tubular body, wherein the fourth hole is axially aligned on the tubular body with the third hole;

a fifth hole formed in the tubular body and positioned axially on the tubular body between the first end and the third hole;

a sixth hole formed in the tubular body, wherein the sixth hole is axially aligned on the tubular body with the fifth hole;

a first groove formed on an inside surface of the tubular body proximate the first end; and a second groove formed on the inside surface of the tubular body proximate the second end.

11. The pump sleeve of claim 10, wherein the first hole and the second hole are circumferentially offset on the tubular body from the third, fourth, fifth, and sixth holes.

12. The pump sleeve of claim 11, wherein the third hole and the fourth hole are circumferentially offset on the tubular body from the fifth and sixth holes.

* * * * *